US005621940A

United States Patent [19]

Lewis et al.

[11] Patent Number: 5,621,940

[45] Date of Patent: Apr. 22, 1997

[54] VEHICLE-MOUNTABLE PUSH BROOM

[75] Inventors: J. Harry Lewis, 68 Glass Avenue, London, Ontario, Canada, N5W 1Z7; Donald A. Lewis, London, Canada

[73] Assignee: J. Harry Lewis, London, Canada

[21] Appl. No.: 641,723

[22] Filed: May 2, 1996

[51] Int. Cl.[6] ..... E01H 1/02

[52] U.S. Cl. ..... 15/78; 15/202

[58] Field of Search ..... 15/78, 183, 194, 15/201–205, 159.1, 340.3

[56] References Cited

U.S. PATENT DOCUMENTS

| | | | |
|---|---|---|---|
| 2,561,025 | 7/1951 | Le Febvre | 15/205 |
| 2,789,298 | 4/1957 | Peterson | 15/194 |
| 2,989,766 | 6/1961 | Hoag | 15/202 |
| 3,086,236 | 4/1963 | Anonsen | 15/203 |
| 3,129,944 | 4/1964 | Amos et al. | 15/202 |
| 5,549,413 | 8/1996 | Bolden | 15/159.1 |

*Primary Examiner*—David Scherbel
*Assistant Examiner*—Terrence Till
*Attorney, Agent, or Firm*—R. Craig Armstrong

[57] ABSTRACT

A vehicle-mountable push broom has a generally horizontal frame provided with a plurality of transverse downwardly-opening generally C-shaped channels, and a plurality of removable bristle strips positionable one in each channel. Each strip has a holder specifically configured to be accommodated within the channel, and a plurality of bristles mounted in and extending downwardly from the holder. The strips are loosely held within the channels, such that the holders are permitted to rock within the channels, for example through an angle generally in the range of 10 to 20 degrees.

4 Claims, 5 Drawing Sheets

VEHICLE-MOUNTABLE PUSH BROOM

BACKGROUND OF THE INVENTION

The invention relates to a vehicle-mountable push broom for sweeping surfaces, especially paved surfaces and the like.

Commercial rotary brooms for sweeping paved surfaces have been used for many years. Generally the brooms are attached to vehicles such as tractors with hydraulic motors or power take-off (PTO) attachments to power the rotary broom. The rotary broom has a tendency to throw dirt, gravel and chemical contaminants which may be on the paved surface into the air, causing visibility problems for the operator as well as the problem of inhaling the particulate and chemicals which are thrown into the air.

Health and safety standards now require the operators of such rotary brooms to wear protective breathing apparatus in many states. Rotary brooms can also propel stones outward which may impact passing cars or pedestrians.

A further drawback of the rotary broom is the high capital cost associated with the mechanisms required to provide the rotation of the broom, such as hydraulic motors or direct PTO drives.

SUMMARY OF THE INVENTION

In the invention as broadly defined, the broom has a generally horizontal frame provided with a plurality of transverse downwardly-opening generally C-shaped channels, and a plurality of removable bristle strips positionable one in each channel. Each strip has a holder specifically configured to be accommodated within the channel, and a plurality of bristles mounted in and extending downwardly from the holder. The strips are loosely held within the channels, such that the holders are permitted to rock within the channels.

In the preferred form of the present invention, a metal housing is formed from sheet steel of a suitable strength such as 10 gauge plate. The housing takes the form of an upside-down shallow pan with removable ends. Generally the pan may be any size, the preferred normal range however being from 4 feet×4 feet×2 inches deep to 1½ feet×7 feet×2 inches deep, depending on the application and/or on the vehicle on which the broom will be mounted. The ends of the pan take the form of angular metal which is bolted to the main pan. The ends are removable to facilitate the installation of the broom bristles.

On the underside of the housing are rows of a profiled steel track welded to the housing. These tracks receive the bristles of the broom. The bristles are formed from lengths of extruded plastic rods of about 1/16" to 1/8" diameter, bundled together in rows and then thermal formed into a plastic profile strip which matches the inside of the profiled track on the housing. With One end removed from the housing, the bristles easily slide into the receiving tracks. Replacing the end then holds the bristles in place.

The top surface of the housing is provided with means to attach to the various vehicles that may be required. One type will have a receiving bracket which will attach to a pickup truck plow mount. This provides a means to lift the broom off of the pavement when not sweeping or to tilt the broom at an angle as a plow blade would be positioned to promote the sweepings to be pushed to one side as the vehicle moves forward.

Another type of bracket would attach to the bucket on a front end loader. A third type of bracket permits attaching the broom to a commercial walk behind lawnmower with the deck removed.

DETAILED DESCRIPTION OF THE PREFERRED EMBODIMENT

Figure 1:
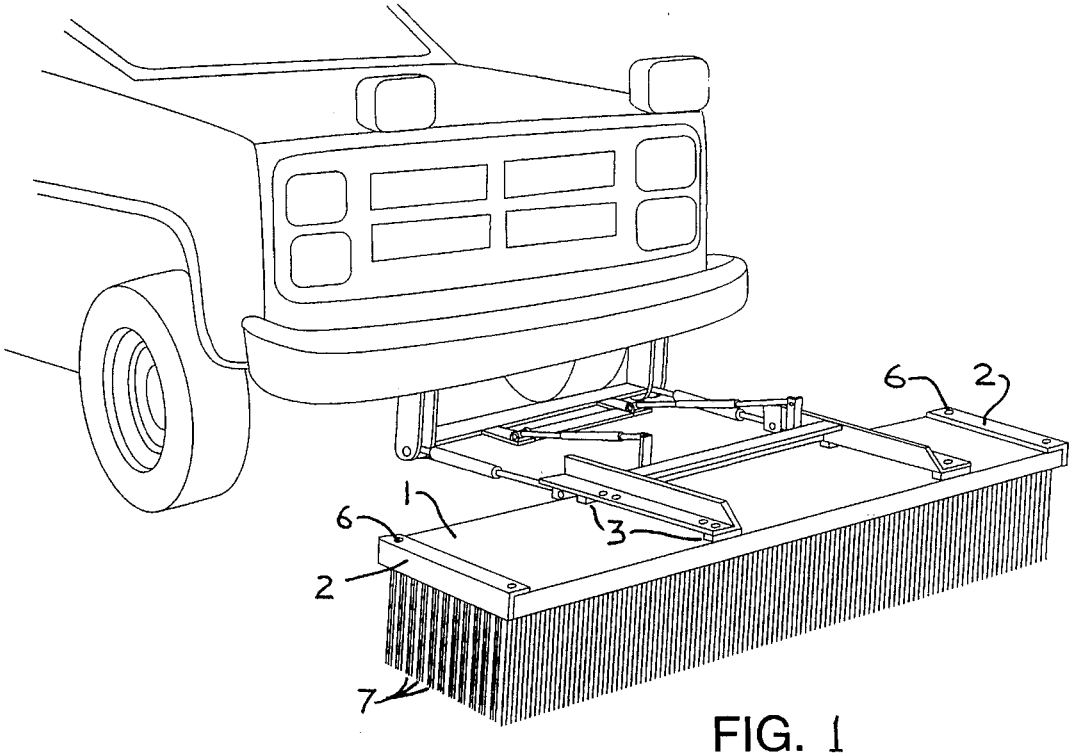
FIG. 1 is a perspective view of a broom mounted on a plow mount for a pickup truck.
Figure 7:
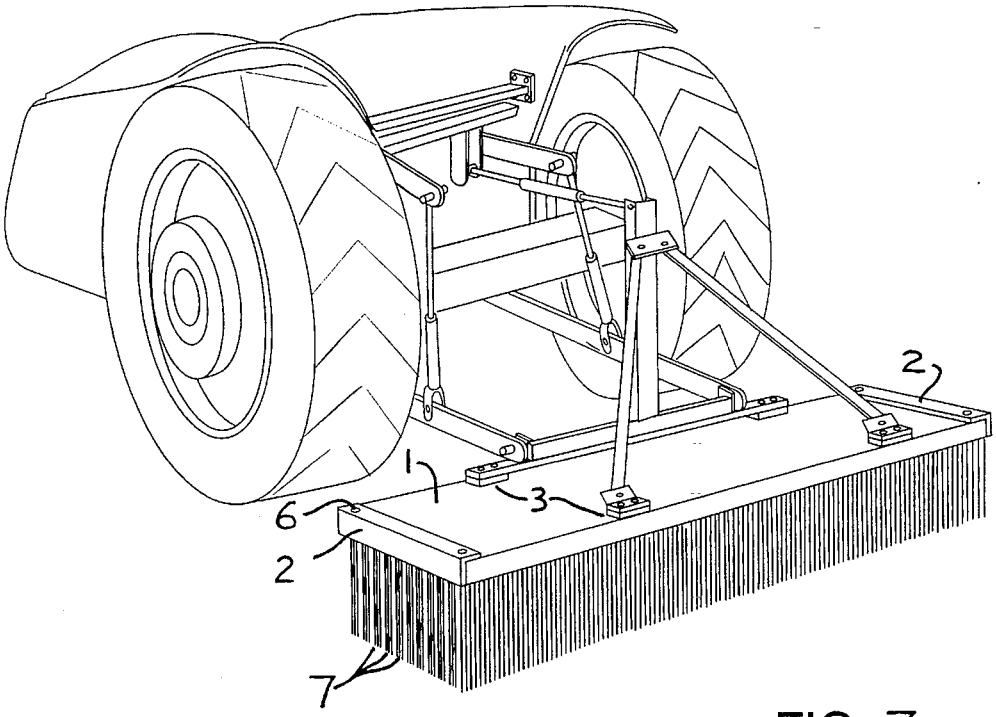
FIG. 7 is a perspective view of a broom mounted behind a tractor.
Figure 2:
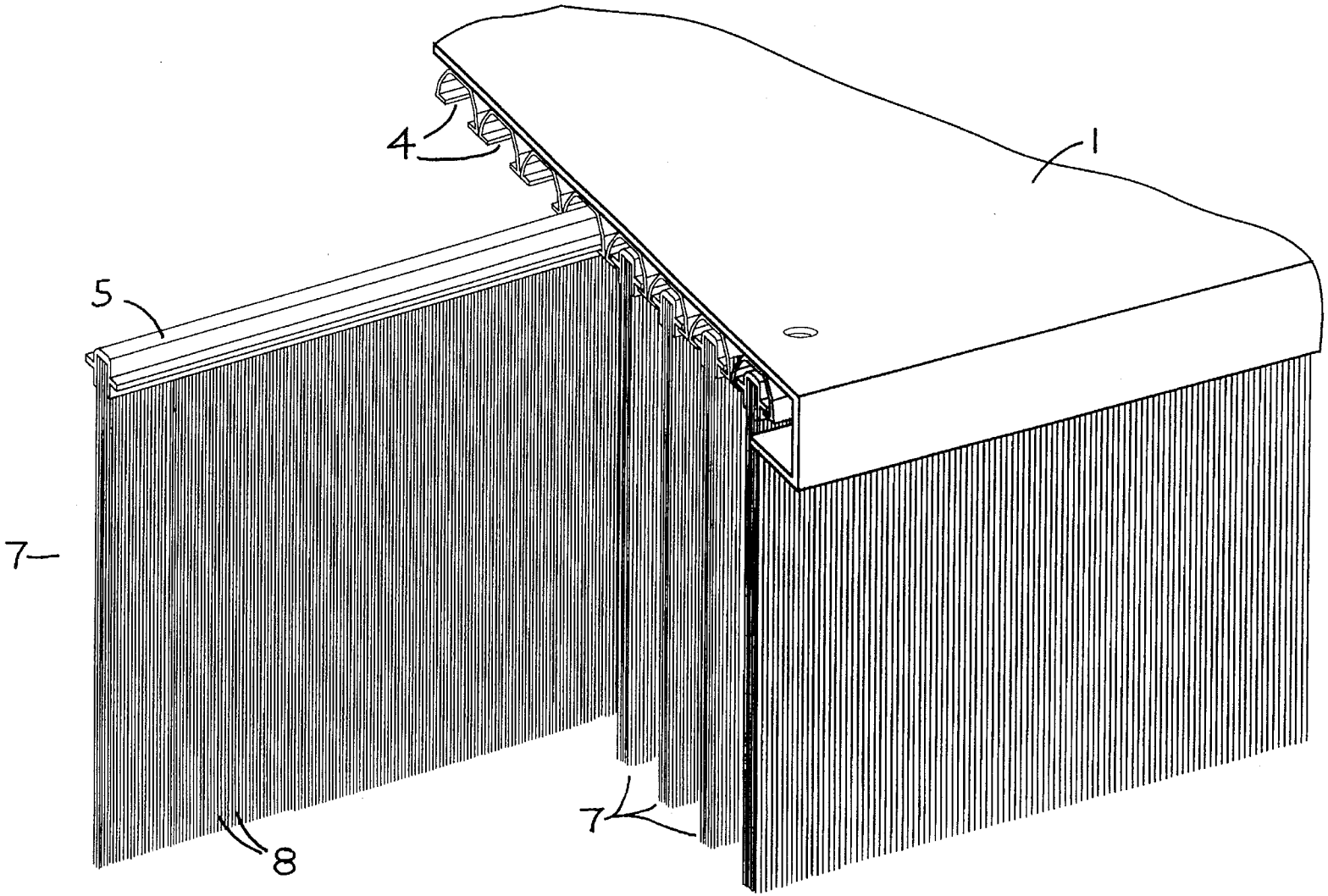
FIG. 2 is a perspective view of a portion of the broom assembly, showing one of the bristle strips partially inserted.
Figure 3:
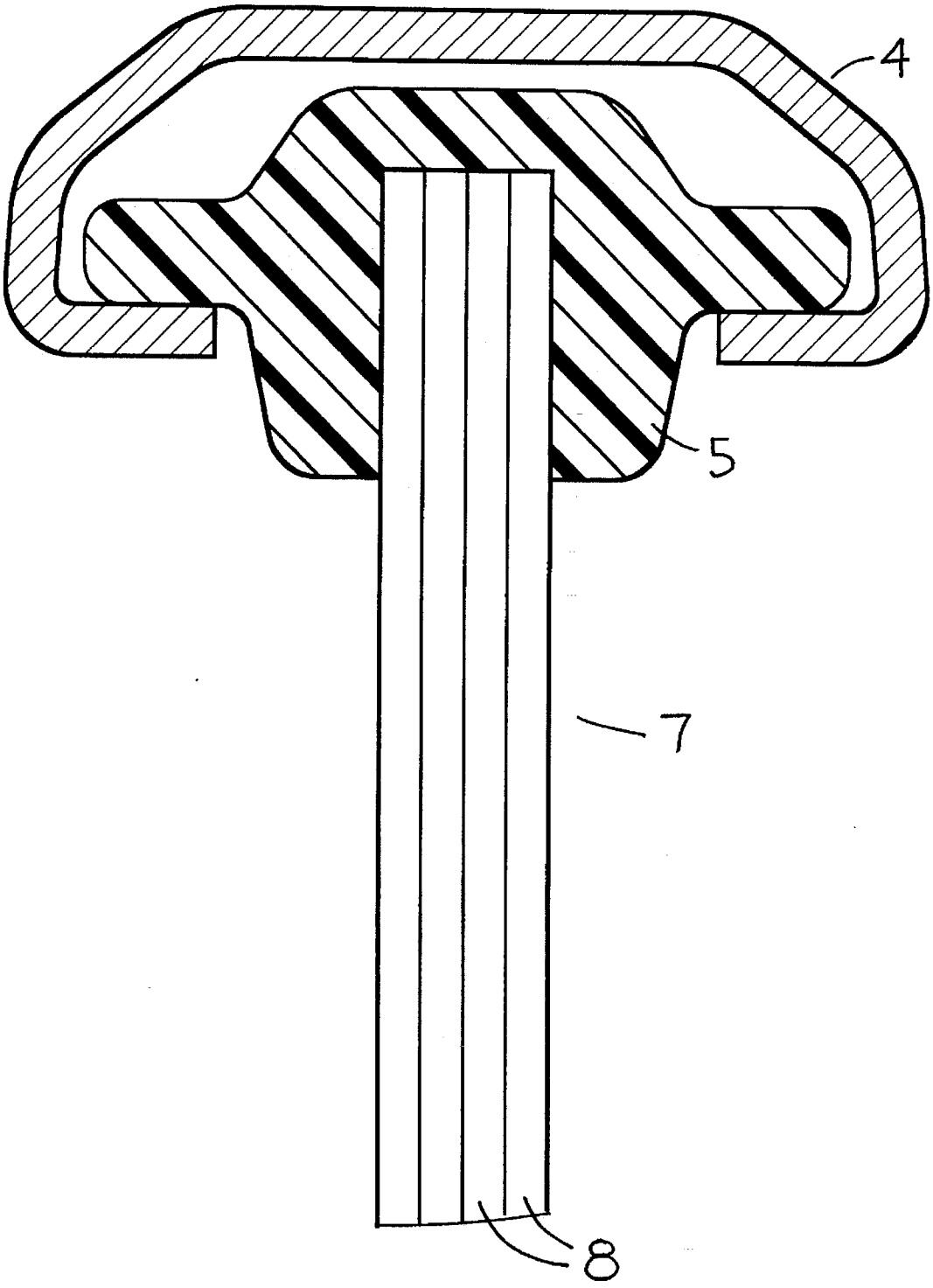
FIG. 3 is a cross-section showing the top of one of the broom strips, mounted in a bristle channel.

The drawings illustrate the presently preferred embodiment of the invention. A heavy sheet metal housing 1 is formed into a rectangular pan with open ends. Angle brackets 2 are attached to the ends of the pan 1 by means of bolts 6. Welded to the top surface of the pan are Four mounting pads 3 for attaching a variety of mounting brackets for different types of vehicles. With one of the angle brackets 2 removed, access to the bristle channels 4 can be obtained.

The bristle channels are formed in the approximate shape of a downwardly-opening "C" with a flat back to provide a surface to weld the channels to the metal housing. Plastic bristles are thermoformed into a plastic hat-shaped holder 5 to Form a bristle strip 7 with multiple bristles 8 projecting downwardly from the bottom of the holder. The bristle strips 5 are slid into the bristle channels 4 to make up transverse rows of bristles.

Figure 4:
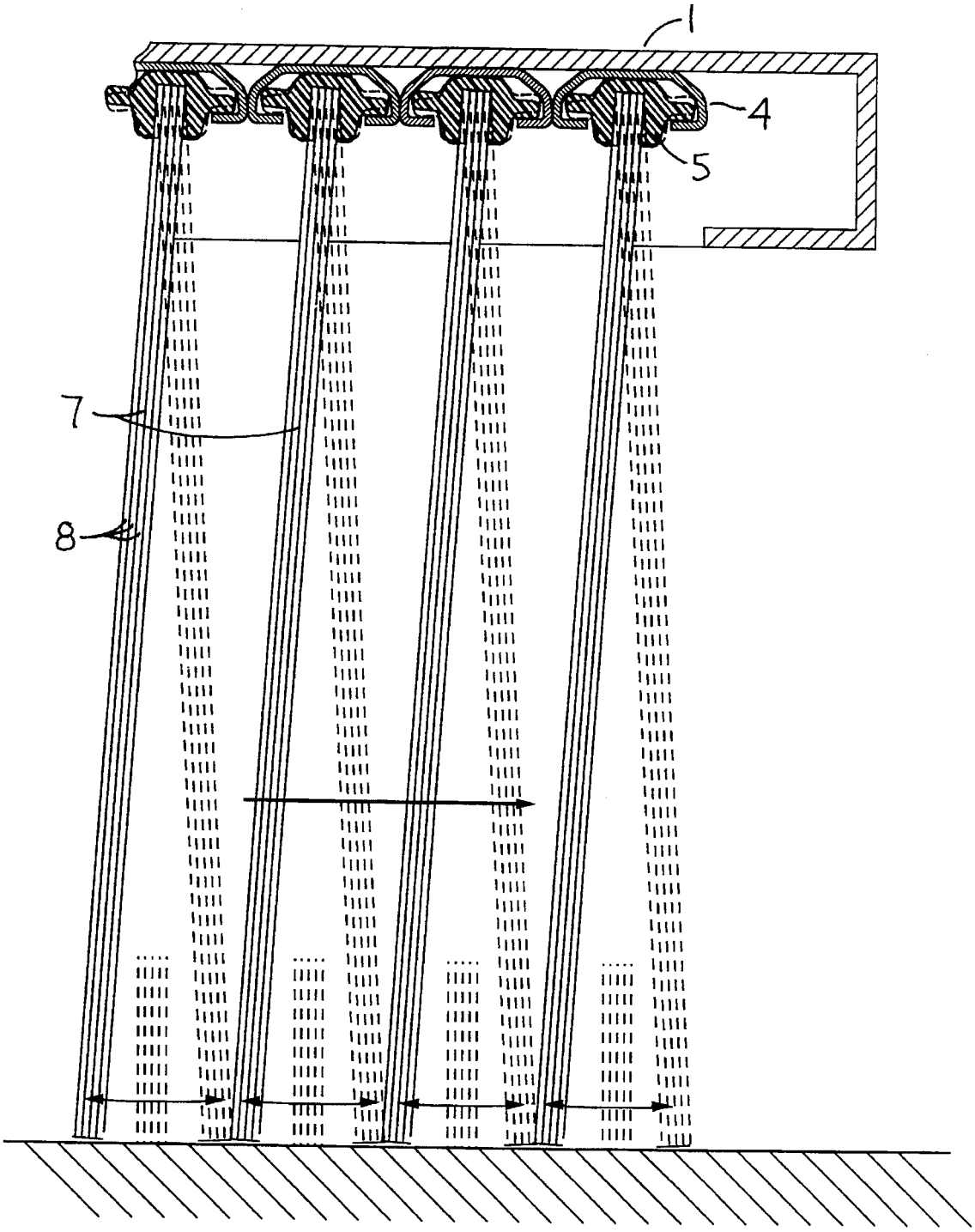
FIG. 4 is a side cross-sectional elevation, showing the sweeping action.
Figure 5:
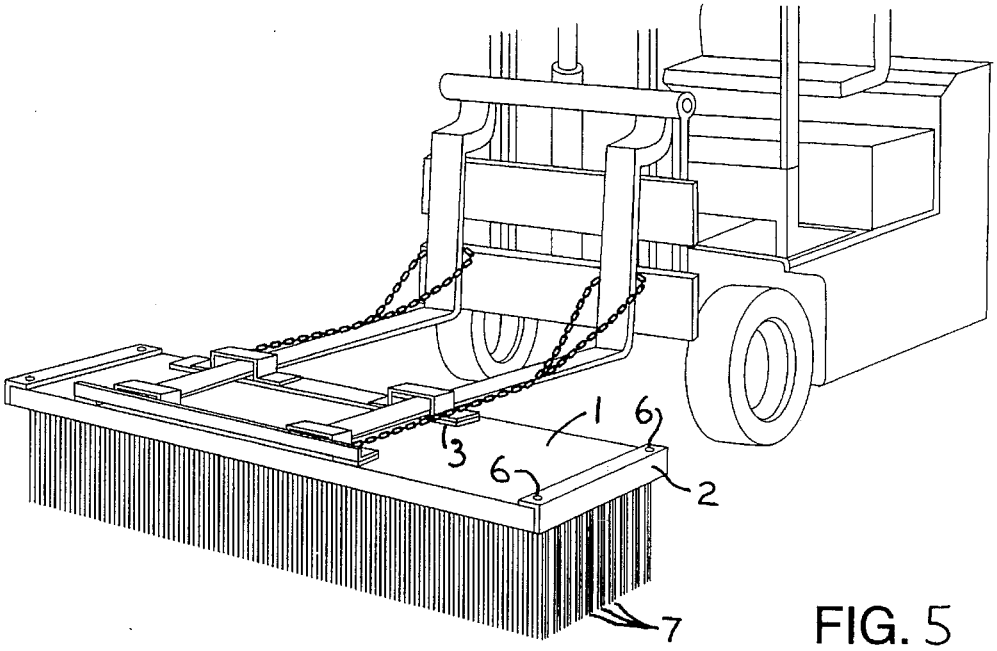
FIG. 5 is a perspective view of a broom mounted on a forklift.
Figure 6:
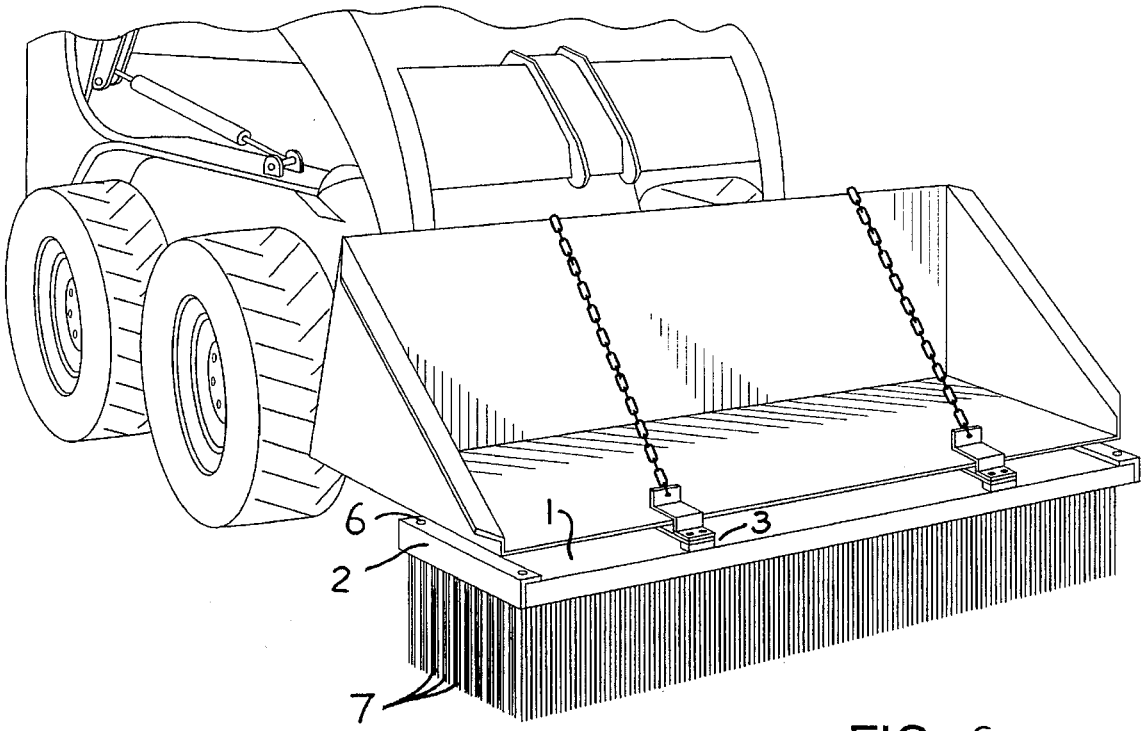
FIG. 6 is a perspective view of a broom mounted on a front-end loader.

The holders 5 are deliberately designed to fit loosely in the channels 4. The fit must be loose enough to allow the bristle strips 7 to rock freely in the channels, in the manner shown in FIG. 4, i.e. through an angle generally in the range of 10 to 20 degrees or thereabouts. The rocking motion produces a sweeping action as the broom drags along a paved surface. This sweeping action is very critical to the proper functioning of the broom. If the bristle strips are in a fixed position and unable to rock back and forth, the effect is similar to pushing a hand broom along the floor in a continuous motion. Material gradually rolls under the bristles and out behind the broom. A hand broom therefore must be pushed forward a bit, drawn back and then pushed forward over and over to properly clean a surface. Since a vehicle mounted unit must provide a clean sweep with a continuous forward motion of the vehicle, such motion of the overall assembly is not possible. However, the present invention surprisingly provides a highly effective substitute action, with amazingly effective results, even at relatively high speeds such as 25 miles per hour.

In the preferred embodiment, the holder 5 and the bristles 8 are both of polypropylene. Typical bristles are approximately 1/16 inch to 1/8 inch in diameter, and 11 inches long, although those dimensions are by no means essential. Each bristle strip may have approximately four bristles across the holder, as illustrated in FIG. 4, for example, but again that is not critical. The overall bristle strip should be relatively stiff, but by no means rigid, to provide the optimum sweeping action.

Wear of approximately 0.002 inches per mile of travel has been noted in tests. Replacement of the bristle strips, when required, is extremely simple and efficient by virtue of the construction of the invention. The angle brackets 2 hold the bristle strips in place; replacement of the bristle strips simply requires removal of one of the angle brackets, sliding out of the old strip or strips, insertion of the new strip, and replacement of the angle bracket.

The precise configurations of the holders 5 and channels 4 are not essential, as long as some channel structure is provided which provide the desired C-shape or the equivalent thereof, such as a series of slots, and as long as the holders 5 are sufficiently loose in the channels to provide the desired degree of rocking. The individual channel pieces are used in the preferred embodiment for ease of initial low-cost manufacturing, but other arrangements may be equally economical and effective, particularly in large volumes.

As can be seen from FIGS. 1 and 5–7, the invention can be readily adapted to and mounted on a variety of vehicles. The overall result of the invention is a highly efficient and effective sweeping tool which can be manufactured and maintained at low cost.

It will be appreciated that the above description relates to the preferred embodiment by way of example only. Many variations of the invention will be obvious to those knowledgeable in the field, and such obvious variations are within the scope of the invention as described and claimed, whether or not expressly described.

What is claimed as the invention is:

1. Apparatus for sweeping surfaces, comprising a generally horizontal frame provided with a plurality of transverse downwardly-opening generally C-shaped channels, and a plurality of removable bristle strips positionable one in each said channel, each said bristle strip comprising a holder specifically configured to be accommodated within said channel, and a plurality of bristles mounted in and extending downwardly from said holder, said holders being only loosely held within said channels, such that said holders are permitted to rock within said channels, creating a sweeping action of said bristles during use of the apparatus.

2. Apparatus as recited in claim 1, where said bristle strips are retained in said channels by at least one removable angle bracket securable on said frame and having a portion extending downwardly to cover otherwise open ends of said channels.

3. Apparatus as recited in claim 1, where said holders are permitted to rock within said channels through an angle generally in the range of 10 to 20 degrees.

4. Apparatus as recited in claim 3, where said bristle strips are retained in said channels by at least one removable angle bracket securable on said frame and having a portion extending downwardly to cover otherwise open ends of said channels.

* * * * *